United States Patent [19]

Gutridge et al.

[11] 4,046,081

[45] Sept. 6, 1977

[54] HEADREST LADDER

[75] Inventors: Jack E. Gutridge, Dyer; Keith J. Hallam, Merrillville; Ronald W. Marsh, Michigan City, all of Ind.

[73] Assignee: Pullman Incorporated, Chicago, Ill.

[21] Appl. No.: 716,728

[22] Filed: Aug. 23, 1976

[51] Int. Cl.[2] ..... B61D 1/08; B61D 31/00

[52] U.S. Cl. ..... 105/326; 5/9 B; 182/97; 297/395

[58] Field of Search ..... 105/317, 321, 326, 2 R, 105/447; 182/91, 97; 297/391, 394, 395, 403, 408; 5/8, 9; 248/240, 240.1, 240.3, 240.4

[56] References Cited

U.S. PATENT DOCUMENTS

| | | | |
|---|---|---|---|
| 1,685,137 | 9/1928 | Nichols | 248/240.4 |
| 1,712,704 | 5/1929 | Kiser | 248/240.4 |
| 2,544,980 | 3/1951 | Brown | 297/67 |
| 2,624,058 | 1/1953 | Kudrna | 182/91 |
| 2,844,109 | 7/1958 | Austgen et al. | 105/321 |
| 3,186,763 | 6/1965 | Ferrara | 297/403 |
| 3,847,246 | 11/1974 | Banner | 182/78 |

*Primary Examiner*—Robert J. Spar
*Assistant Examiner*—Carl Rowold
*Attorney, Agent, or Firm*—Richard J. Myers

[57] ABSTRACT

A convertible passenger seat headrest for a railway sleeping compartment having a convertible seat and bed arrangement. The headrest is pivotally supported from the compartment wall at its lower end and includes a stowable ladder folded within it when the headrest is in the raised position. When it is desired to make up the upper berth of the sleeping compartment, the headrest can be pivoted outwardly from the wall and the ladder unfolded to form a ladder and step which a passenger can use to climb into the upper berth.

5 Claims, 7 Drawing Figures

HEADREST LADDER

BACKGROUND OF THE INVENTION

1. Field of the Invention

The present invention pertains to a combination passenger seat headrest and access ladder for a transportation vehicle and particularly for a railway sleeper car.

2. Description of the Prior Art

In a vehicle having sleeping compartments and particularly in a railroad sleeper car having double or triple berths, it is necessary to provide a ladder or a series of steps which a passenger can use to climb into the second or third berth.

In railroad sleeper cars, the usual means has been for the railroad to employ porters to bring ladders or steps to the sleeping compartments when the berths are to be made up. However, since the steps or ladders had to be stored during the day, valuable car space was necessarily needed to store the steps or ladders when they were not in use. Another means of providing passenger access to an upper berth is shown in U.S. Pat. No. 2,778,320. That patent discloses a sliding shelf-like step secured and stored beneath a lower sleeper car berth. Another type of step is shown in U.S. Pat. No. 1,953,298 which discloses a variety of single pivotally folding steps for workmen. Still another step is shown in U.S. Pat. No. 3,847,246 which shows an emergency fire escape means mounted on the wall of a building below a window or a door.

SUMMARY OF THE INVENTION

The present invention relates to a passenger sleeping compartment of a railway car. In the present arrangement, each passenger compartment includes a pair of facing passenger seats spaced apart from one another which can be made up into lower berths and an upper berth which may be folded down when the compartment is made up substantially as described in U.S. Pat. application Ser. No. 670,919 filed Mar. 26, 1976 and incorporated by reference herein.

The invention provides that one of the compartment seats include a headrest pivotally supported from the compartment wall at its lower end which includes a stowable ladder folded within it when the headrest is in the raised position. When it is desired to make up the upper berth of the sleeping compartment, the headrest can be pivoted outwardly from the wall and the ladder unfolded to form a ladder which a passenger can use to climb into the upper berth, as well as a cantilevered step which also serves as a night table for the upper berth passenger. Thus, as will be apparent from the applicants' description of their invention, the seat headrest optimizes the economy of car space and utility while at the same time providing a comfortable and convenient means for a passenger to climb into the upper berth.

DESCRIPTION OF THE PREFERRED EMBODIMENT

Figure 2:
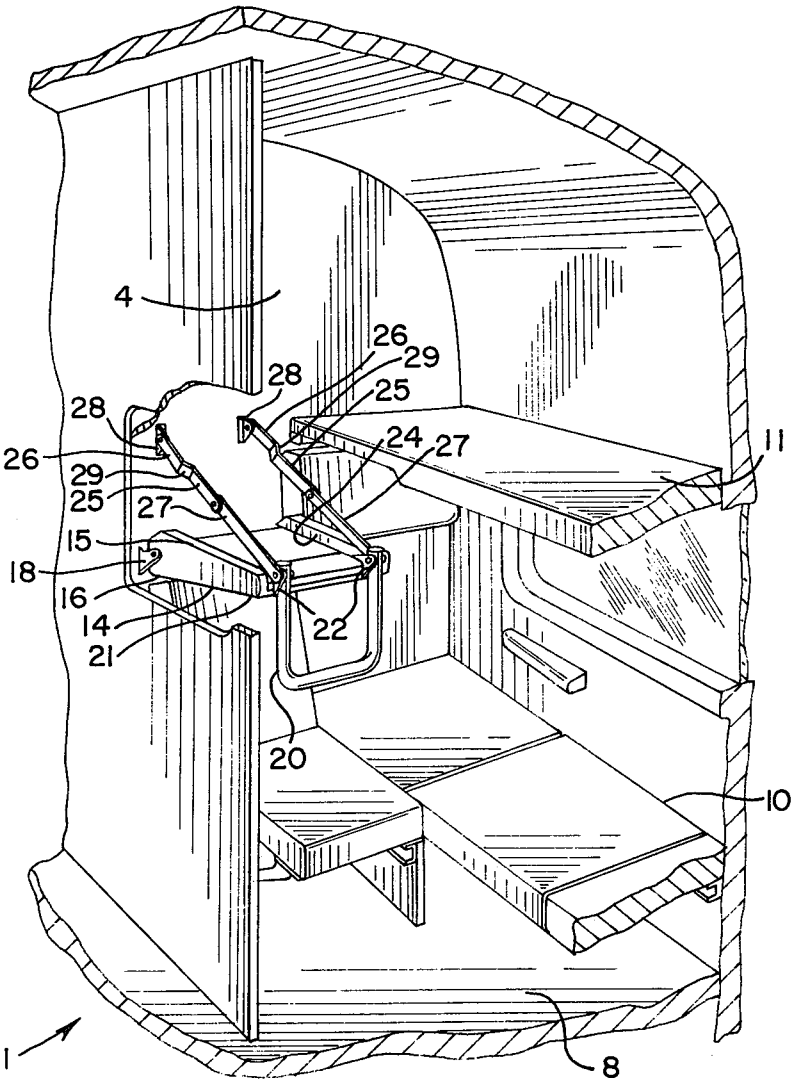
FIG. 2 shows the compartment of FIG. 1 made up in the sleeper condition and the headrest in its horizontal lowered position.
Figure 1:
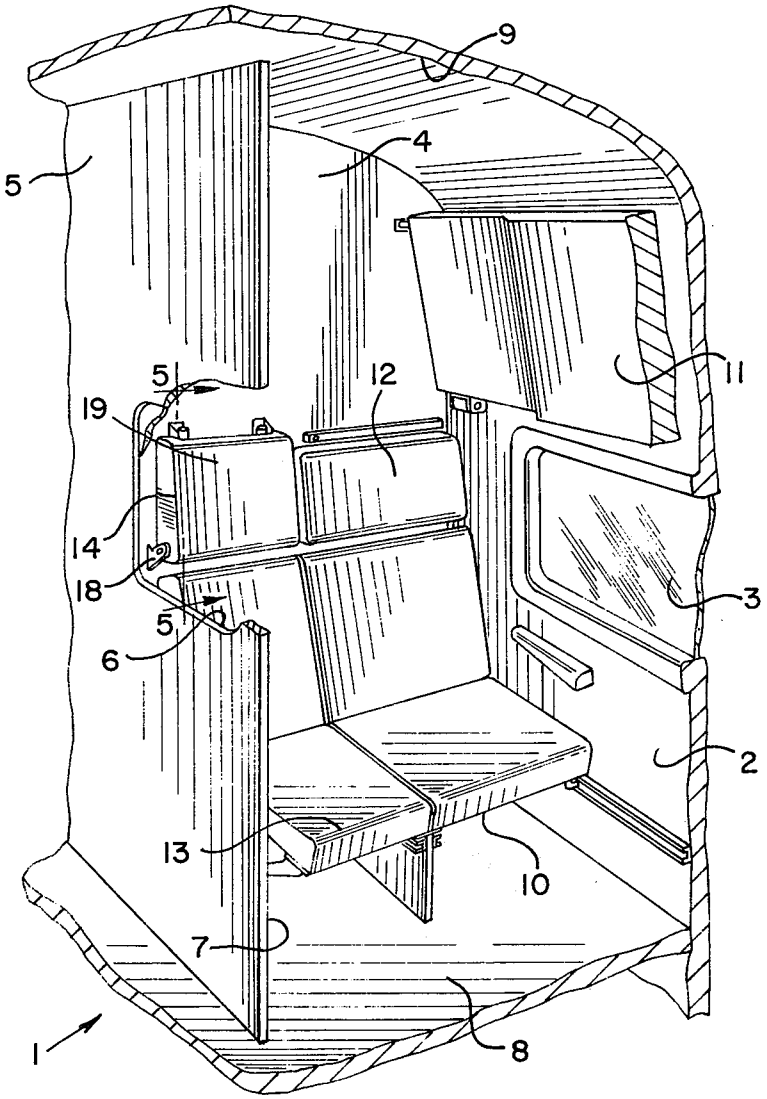
FIG. 1 is a perspective view of approximately one-half of a sleeping car compartment showing the headrest of the invention in the raised position.

Turning now to consideration of the drawings, FIGS. 1 and 2 show a portion of a railway sleeper car compartment. The compartment 1 includes an outer car wall 2 having a window 3, laterally inwardly extending partition walls 4, and an inner divider wall 5 including a window 6 and door opening 7 and a floor 8 and ceiling or roof 9. The total compartment includes a pair of seats 10 positioned in face-to-face relation and an upper hinged berth 11 which can be moved between a stored position as shown in FIG. 1 or a made-up position as shown in FIG. 2. Each seat has an associated headrest 12 supported from its adjacent partition wall 4 and the headrest provided for one of the inner seats 13 embodies the headrest step ladder 14 of the applicants' invention.

The headrest step ladder 14 includes a step portion 15 which is pivotally secured at its lower end 16 to the car partition wall 4 by a hinged rod 17 extending between a pair of hinge rod brackets 18 cantilevered from the walls 4. A cushioning portion 19 is secured to the outer surface of the step 15 which forms the contoured cushion of the seat headrest 14. The back of the step 15 is recessed to accommodate a foldable U-shaped tubular ladder 20 which is pivotally coupled to the upper or outer end 21 of the step 15 through clevis-like brackets 22 secured to the step by pins or rivets 23.

Figure 5:
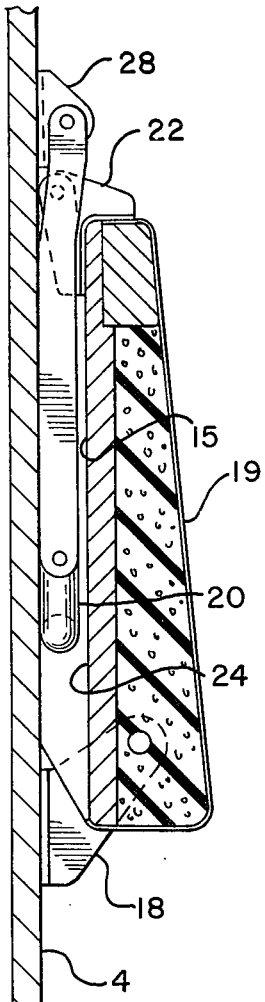
FIG. 5 is a side sectional view taken generally along line 5—5 of FIG. 1.
Figure 6:
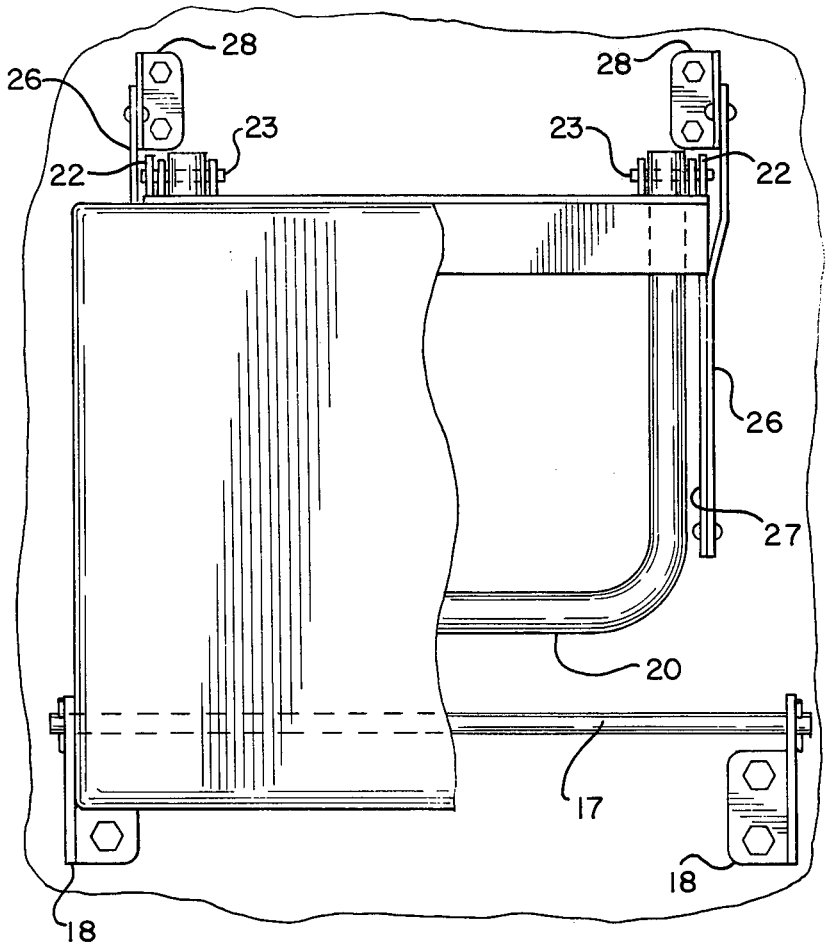
FIG. 6 is an end elevation view partially in section showing the ladder in the stored position.
Figure 7:
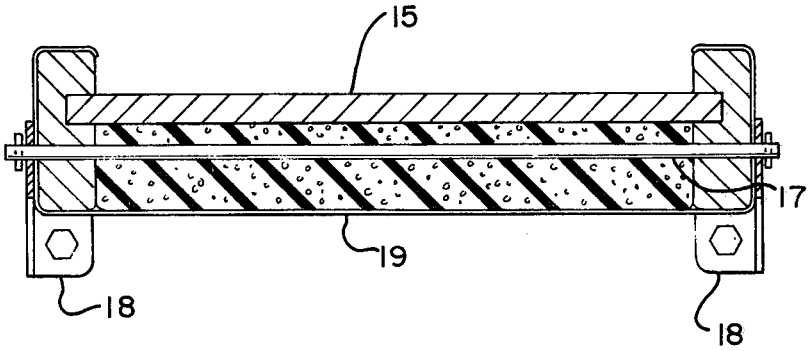
FIG. 7 is a sectional view taken generally along line 7—7 of FIG. 3.

As shown in FIGS. 5 and 6, when the headrest 14 is in its raised position the ladder 20 is unobstructively stowed in the recess 24. Thus, when the upper berth is made up, the step 15 may be rotated out from the wall 4 to the horizontal lowered position and the ladder 20 rotated about the brackets 22 to a vertically depending position.

Figure 4:
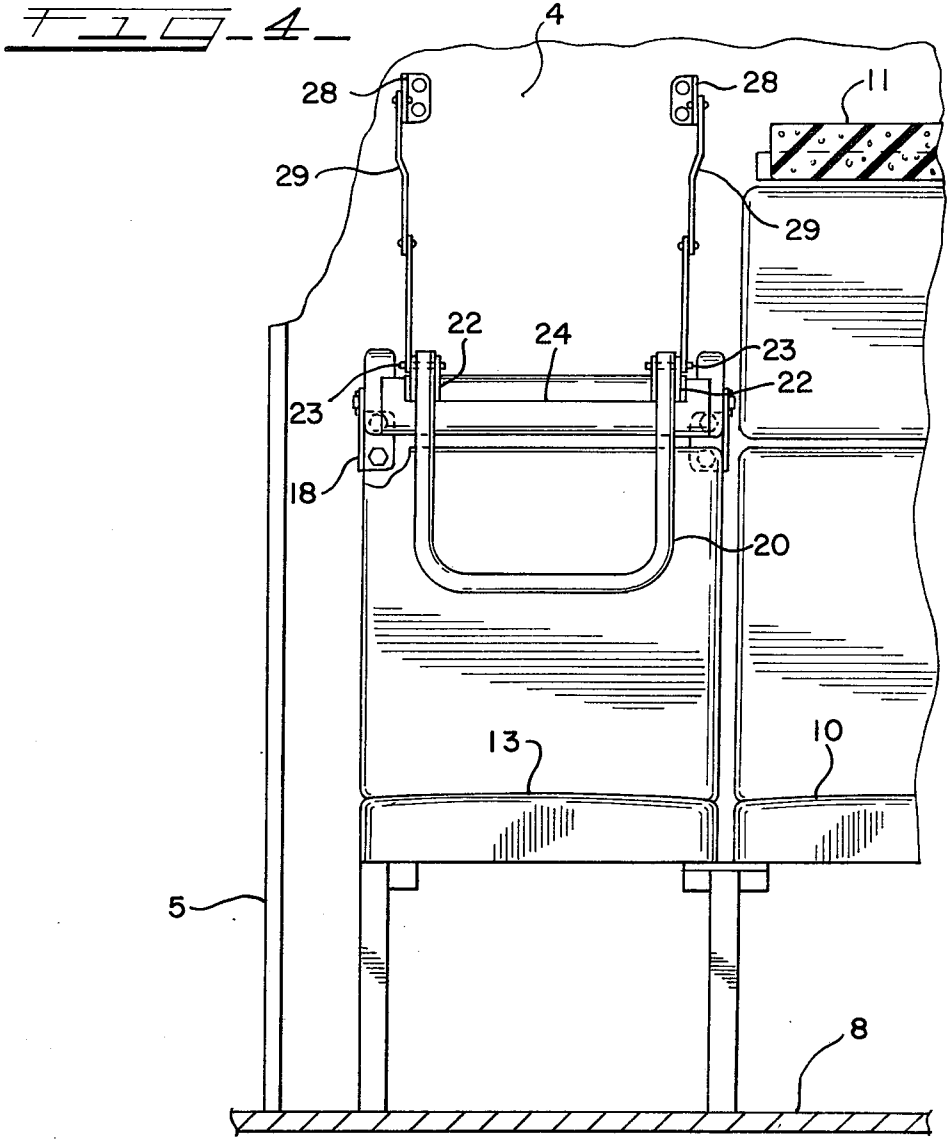
FIG. 4 is an end elevation view of the invention in the lowered position.
Figure 3:
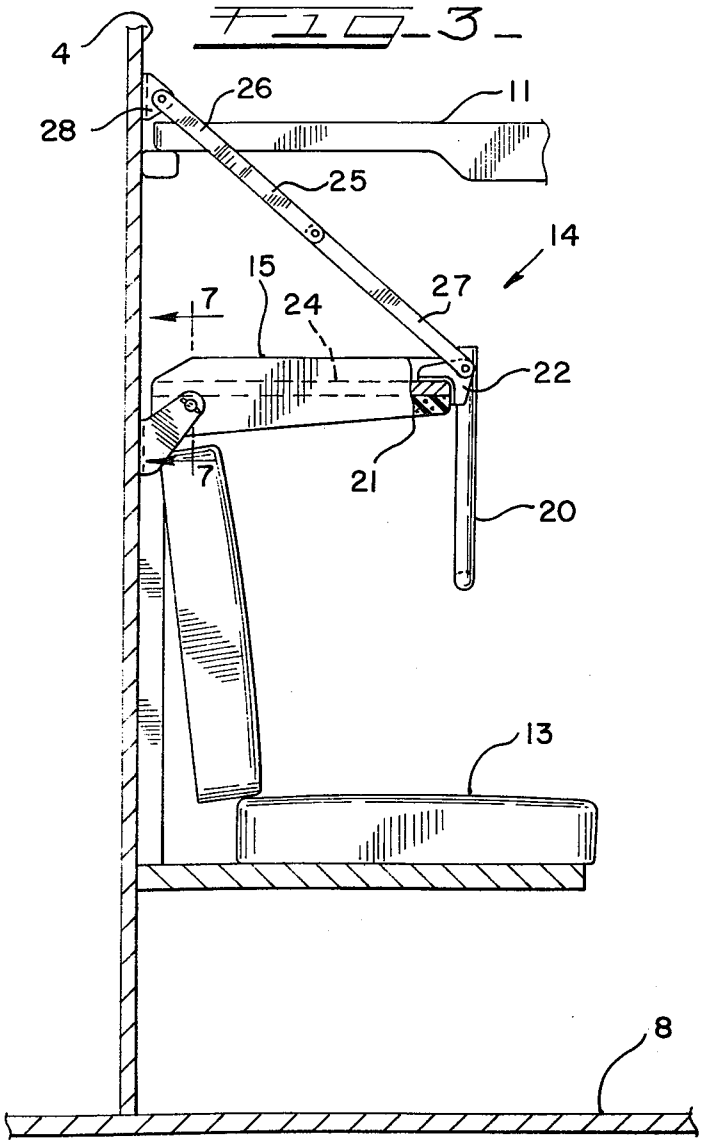
FIG. 3 is a side elevation view of the invention in the lowered position.

To suspend or support the step 15 in its lowered position, a pair of laterally spaced, outwardly and downwardly diagonal braces or tension straps 25 are provided. The straps 25 each include an upper member 26 pivotally connected to a lower member 27 in jackknifing fashion. The upper members 26 of the straps 25 are pivotally coupled to the partition wall 4 by strap brackets 28 cantilevered from the wall 4 above the step 15 and the lower members 27 are pivotally coupled to the upper or outer end 21 of the step 15 through the brackets 22 by the pins or rivets 23. The pivotal connections between the members 26 and 27 and brackets 22 and 28 are snug fitting and provide sufficient frictional engagement therebetween to hold the headrest in the vertical position. As illustrated in FIG. 4, the tension straps 25 are laterally spaced within the recess 24 so that they can be unobstructively stored therein when the headrest is in the vertical position.

The invention also provides that the upper members 26 of the tension straps 25 include laterally diagonally formed bent portions 29 which assure clearance between the brackets 22 and the upper members 26 when the headrest 14 is moved to the raised position as well as accommodate slight extensible flexure of the tension straps 25 to assure proper horizontal alignment of the step portion 15 in the event of slight warping of the partition walls 4 after extended use of the car when the headrest is moved to the horizontal position.

The foregoing description and drawings merely explain and illustrate the invention and the invention is not limited thereto except insofar as the appended claims are so limited as those skilled in the art who have the disclosure before them will be able to make modifications and variations therein without department from the scope of the invention.

What is claimed is:

1. A sleeping compartment in a passenger vehicle including an outer wall, longitudinally spaced laterally partition walls, an upper bed connected to one of said walls for movement from a stored to a horizontal position, a passenger seat proximate to said bed, and an improved headrest associated with said seat adapted to selectively provide a seat headrest and passenger access ladder and step, said headrest having upper and lower edge portions and a rigid back portion, hinge means pivotally coupling said lower edge portion to an associated wall to accommodate movement of the headrest from a generally vertical position to an essentially horizontal load supporting position, upper support means coupling said upper edge portion and said associated wall in load supporting relation, and a ladder having an inner end section pivotally coupled to said upper edge portion and an outer end section movable thereabout; whereby, when the headrest is in the vertical position the ladder is stowably interposed between the back portion and the associated wall, and when the headrest is in the horizontal position the ladder depends vertically therefrom.

2. The invention according to claim 1, and said back portion being recessed to accommodate stowage of said ladder therewithin.

3. The invention according to claim 1, and said ladder being U-shaped and including upper end portions pivotally coupled to said upper edge portion.

4. The invention according to claim 1, and said upper support means including horizontally spaced tension braces, each brace including an upper strap and a lower strap, and said straps being pivotally coupled in jackknifing relation.

5. The invention according to claim 1, and said hinge means including a pair of horizontally spaced brackets cantilevered from said associated wall about said lower edge portions, and pin means coupling said lower edge portion to the brackets.

* * * * *